US005538078A

United States Patent [19]

Mizuno et al.

[11] Patent Number: 5,538,078

[45] Date of Patent: Jul. 23, 1996

[54] ALUMINUM-CONTAINING METAL COMPOSITE MATERIAL AND PROCESS FOR PRODUCING SAME

[75] Inventors: Hiroyoshi Mizuno, Anjo; Ryosuke Sako, Tokyo; Tomohiro Osako, Tokyo; Osamu Furuyama, Tokyo, all of Japan

[73] Assignees: Nippondenso Co., Ltd., Kariya; Nihon Parkerizing Co., Ltd., Tokyo, Japan

[21] Appl. No.: 418,643

[22] Filed: Apr. 5, 1995

[30] Foreign Application Priority Data

Apr. 8, 1994 [JP] Japan ..... 6-070524

[51] Int. Cl.[6] ..... F28F 13/18

[52] U.S. Cl. ..... 165/133; 165/134.1; 427/409

[58] Field of Search ..... 165/133, 134.1; 427/2.3, 409

[56] References Cited

U.S. PATENT DOCUMENTS

| | | | |
|---|---|---|---|
| 4,452,945 | 6/1984 | Bowen et al. | 427/409 |
| 4,830,101 | 5/1989 | Ohara et al. . | |
| 4,939,015 | 7/1990 | Riccio et al. | 427/409 |
| 4,954,372 | 9/1990 | Sako et al. . | |
| 5,035,282 | 7/1991 | Kawashita et al. | 165/133 |
| 5,439,710 | 8/1995 | Vogt et al. | 427/409 |
| 5,474,956 | 12/1995 | Trask et al. | 427/409 |

FOREIGN PATENT DOCUMENTS

| | | |
|---|---|---|
| 0274738 | 7/1988 | European Pat. Off. . |
| 0409130 | 1/1991 | European Pat. Off. . |
| 0497560 | 8/1992 | European Pat. Off. . |
| 60-150838 | 8/1985 | Japan . |
| 61-227877 | 10/1986 | Japan . |
| 61-250495 | 11/1986 | Japan . |
| 1174438 | 7/1989 | Japan . |
| 1270977 | 10/1989 | Japan . |
| 2215871 | 8/1990 | Japan . |
| 326381 | 2/1991 | Japan . |

*Primary Examiner*—Edward K. Look
*Assistant Examiner*—Mark Sgantzos
*Attorney, Agent, or Firm*—Cushman, Darby & Cushman

[57] ABSTRACT

An aluminum-containing metal composite material useful for heat exchangers having a satisfactory hydrophilic property, water-resistance and resistance to swelling with water and an enhanced durability is produced by coating an aluminum-containing metal substrate with an undercoat chemical conversion layer and then with an uppercoat resinous layer formed from a cross-linking reaction product of a polymeric compound (a) having a reactive amide, hydroxyl or carboxyl group with a cross-linking agent (b), in the presence of a water-soluble polymeric compound (c) having a sulfonic or sulfonate group, and in the cross-linking reaction product, the cross-linked molecules of the polymeric compound (a) form water-insoluble, three-dimensional network structures, and the molecules of the polymeric compound (c) are held in the network structures and thereby exhibit substantially no eluting property in water.

30 Claims, 3 Drawing Sheets

ALUMINUM-CONTAINING METAL COMPOSITE MATERIAL AND PROCESS FOR PRODUCING SAME

BACKGROUND OF THE INVENTION

1. Field of the Invention

The present invention relates to an aluminum-containing metal composite material and a process for producing the same. More particularly, the present invention relates to an aluminum-containing metal composite material having a satisfactory hydrophilic property and water-resistance and usable for heat-exchangers, for example, evaporators for car air-conditioners, and a process for producing the same with a high efficiency.

2. Description of the Related Art

It is well known that a conventional heat-exchanger has a plurality of tubes through which a first heat-conductive fluid flows and a plurality of fins extending from the tubes and being exposed to a second heat-conductive fluid. Generally, the larger the total surface area through which heat is exchanged between the first and second heat-conductive fluids, the higher the heat exchange efficiency. Therefore, the heat-exchanger, for example, an evaporator, is designed so that the cooling area of the evaporator is made as large as possible, to enhance the cooling effect of the evaporator. Also, to make the size of the evaporator as small as possible, the gaps between the fins is made very small.

As a result of the above-mentioned design, moisture in the air is condensed to form water drops between the fins and the water drops formed between the fins causes the flow of the second heat-conductive fluid to be hindered and the heat exchange efficiency of the heat exchanger to decrease. Also the water drops are scattered into the downstream side of the evaporator so as to reduce the heat exchange efficiency.

Further, the condensed water drops between the fins cause dust in the air to adhere to the fins and to be accumulated in the gaps between the fins. The adhered dust causes a propagation of bacteria in the gaps between the fins, and the propagated bacteria produce metabolic products which generate an unpleasant odor.

Japanese Unexamined Patent Publication (Kokai) No. 61-250,495 discloses a heat exchanger in which the above-mentioned disadvantages are eliminated. In this heat exchanger, a chemical conversion layer is formed on a substrate comprising an aluminum-containing metal material and a hydrophilic resinous coating layer is formed on the chemical conversion layer. This hydrophilic resinous coating layer effectively prevents the formation of the water drops between the fins and the increase in the flow resistance of the second heat-conductive fluid due to the water drops. Also, the Japanese publication states that the generation of the unpleasant odor derived from the bacterial metabolic products can be prevented by adding an antibacterial agent or a deodorant to the resinous coating layer.

Nevertheless, the inventors of the present invention have in depth investigated the technique of the Japanese publication and found that this technique is disadvantageous in that the hydrophilic resinous coating layer is gradually eluted in the condensed water and cannot be made to appear over a long period of employment.

Namely, due to the poor water resistance of the hydrophilic resinous coating layer, in the employment environment in which a heat exchange surface of, for example, an evaporator, is always brought into contact with water, the hydrophilic resinous coating layer is consumed to an extent that during a practical use for about one year, the amount of the hydrophilic resinous coating layer decreases to about 10% of the initial amount thereof, and the resultant coating layer exhibits a significantly reduced hydrophilic property and antibacterial property. Also, the inventors have found that as a result of the elution of the resinous coating layer, the surface of the aluminum-containing metal substrate partially exposed to the outside and slightly corroded. This corrosion causes a stimulative odor to be generated.

As an attempt to prevent the elution of the hydrophilic resinous coating layer in the condensed water, Japanese Unexamined Patent Publication (Kokai) No. 1-270,977 discloses a process for coating an aluminum surface with a hydrophilic resinous layer by applying a mixture solution of a water-soluble, cross-linkable acrylamide polymer ($P_1$), a water-soluble polymer ($P_2$) having hydrophilic groups, for example, carboxyl, sulfonic or phosphoric groups, amino groups or quaternary ammonium groups, and a water-soluble cross-linking agent compatible with the polymers ($P_1$) and ($P_2$) to an aluminum surface and drying the coated mixture solution layer.

Also, as another attempt, Japanese Unexamined Patent Publication (Kokai) No. 3-26,381 discloses a process for coating an aluminum surface with a hydrophilic resinous coating layer by treating the aluminum surface with a mixture solution of a water-soluble polyvinyl alcohol and/or derivative thereof ($P_1$), a water-soluble polymer ($P_2$) having carboxylic, sulfonic or phosphoric groups and a water-soluble cross-linking agent compatible with the polymers ($P_1$) and ($P_2$).

In these prior art processes, the water-soluble polymers ($P_1$) and ($P_2$) are cross-linked and made water-insoluble. The resultant resinous layers are difficult to dissolve in the condensed water. When the resultant aluminum material having the cross-linked resinous coating layer is used in the formation of an air-conditioner, it is alternately wetted with the condensed water and dried. In the wetting-drying cycles, the resinous coating layer is alternately swollen with water and dried. The wetting-drying cycles cause the resinous coating layer to be deteriorated and then broken and removed.

Usually, where an air conditioner having complicated heat-exchange surfaces is coated with the resinous solution by immersion, it is difficult to uniformly distribute the resinous solution on the complicated surfaces of the air conditioner. Namely, in some portions of the air conditioner, the resinous solution is distributed in an excessive amount. The deterioration of the resinous coating layer significantly occurs in the excessively coated portions. The removed resinous layer are scattered throughout the air conditioner when it is operated. Also, the removal of the resinous coating layer causes portions of the aluminum surface to be exposed to the outside, and a stimulative odor to be generated due to the corrosion of the exposed surface portions. Therefore the above-mentioned prior arts are not satisfactory to provide an aluminum material having a resinous coating layer and capable of practical use over a long period without removal of the resinous coating layer.

SUMMARY OF THE INVENTION

An object of the present invention is to provide an aluminum-containing metal composite material provided with a hydrophilic resinous coating layer capable of maintaining an excellent resistance to deterioration over a long period and exhibiting satisfactory hydrophilic property and antibacterial property and a low odor-generating property, and a process for producing the same.

The present invention covers heat exchangers comprising the above-mentioned aluminum-containing metal composite material and a process for producing the heat exchangers.

The above-mentioned object can be attained by the aluminum-containing metal composite material of the present invention and the process of the present invention for producing the same.

The aluminum-containing metal material of the present invention comprises (A) a substrate comprising an aluminum-containing metal material;

(B) an undercoat chemical conversion layer formed on the substrate; and (C) an uppercoat resinous layer formed on the undercoat chemical conversion layer and comprising a cross-linking reaction product of (a) a water-soluble and cross-linkable polymeric compound having (i) 80 to 100 molar % of principal polymerization units each having at least one reactive functional group selected from the class consisting of amide, hydroxyl and carboxyl groups and (ii) 0 to 20 molar % of additional polymerization units different from the principal polymerization unit (i), with (b) a cross-linking agent reacted with the reactive functional group of the polymeric compound (a) to cross-link the molecules of the polymeric compound (a) to each other, in the presence of (c) a water-soluble polymeric compound having (iii) 10 to 100 molar % of principal polymerization units each having at least one hydrophilic group selected from the class consisting of sulfonic group and sulfonate groups and (iv) 0 to 90 molar % of additional polymerization units different from the principal polymerization unit (iii), in the cross-linking reaction product, the molecules of the polymeric compound (a) cross-linked with the cross-linking agent (b) forming water-insoluble, three-dimensional network structures, and the molecules of the water-soluble polymeric compound (c) being held in the water-insoluble, three-dimensional network structures and thereby exhibiting substantially no eluting property in water.

The process of the present invention for producing the aluminum-containing metal composite material comprises the steps of:

(A) applying a chemical conversion treatment to a surface of a substrate comprising an aluminum-containing metal material to form an undercoat chemical conversion layer on the substrate; and (B) coating the surface of the undercoat chemical conversion layer with a coating liquid comprising:

(a) a water-soluble and cross-linkable polymeric compound having (i) 80 to 100 molar % of principal polymerization units each having at least one reactive functional group selected from the class consisting of amide, hydroxyl and carboxyl groups and (ii) 0 to 20 molar % of additional polymerization units different from the principal polymerization units (i), (b) a cross-linking agent reactive with the reactive functional group of the polymeric compound (a), and (c) a water-soluble polymeric compound having (iii) 10 to 100 molar % of principal polymerization units each having at least one hydrophilic group selected from the class consisting of sulfonic group and sulfonate groups and (iv) 0 to 10 molar % of additional polymerization units different from the principal polymerization units (iii), (C) curing the coated coating liquid on the undercoat layer at a temperature of from 80° C. to 300° C., to cross-link the molecules of the polymeric compound (a) to each other with the cross-linking agent (b) in the presence of the polymeric compound (c) and thereby to form an uppercoat resinous layer on the undercoat chemical conversion layer, in the cross-linking reaction, the molecules of the polymeric compound (a) cross-linked with the cross-linking agent (b) forming water-insoluble, three-dimensional network structures, and the molecules of the water-soluble polymeric compound (c) being held in the water-insoluble, three-dimensional network structures and thereby exhibiting substantially no eluting property in water.

DESCRIPTION OF THE PREFERRED EMBODIMENTS

Figure 1:
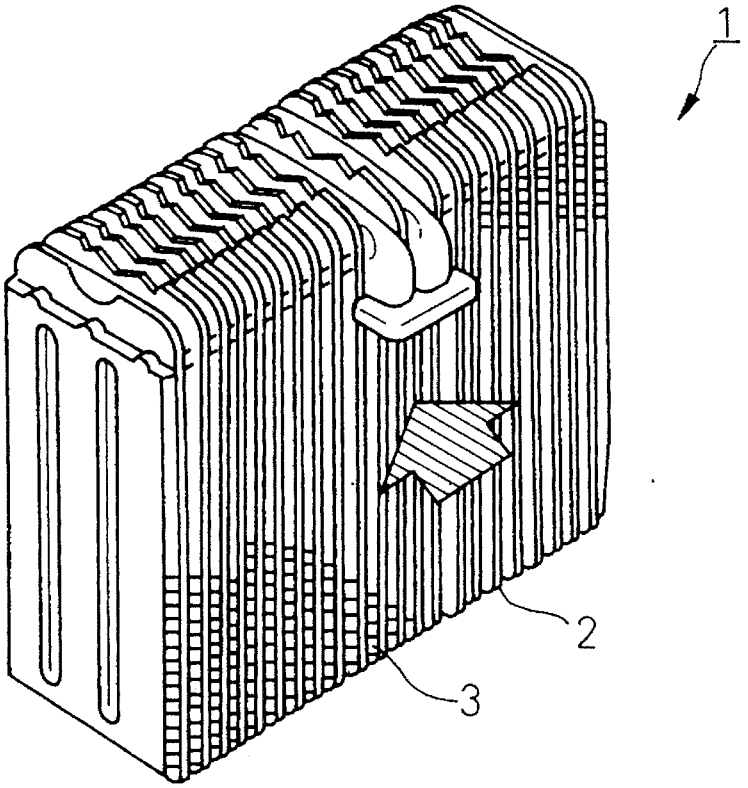
FIG. 1 is a perspective view of an evaporator for a car air conditioner, which is usable as a substrate of the aluminum-containing metal composite material of the present invention.

The aluminum-containing metal material usable as a substrate of the composite material of the present invention includes sheets, strips, plates and other shaped articles, for example, tubes, fins hollow plates, usable, for example, for heat-exchangers such as air conditioners, formed from aluminum or an aluminum alloy selected from, for example, aluminum-magnesium alloys, aluminum-silicon alloys and aluminum-manganese alloys.

The substrate surface is coated with an undercoat chemical conversion layer.

The undercoat chemical conversion layer is formed by applying a chemical conversion treatment for example, a chromic acid-chromate treatment, a phosphoric acid-chromate treatment, a zinc phosphate treatment, a zirconium phosphate treatment, or a titanium phosphate treatment, to a surface of the aluminum-containing metal substrate.

Namely, the undercoat chemical conversion layer preferably comprises at least one member selected from the class consisting of chromic acid-chromate treatment products, phosphoric acid-chromate treatment products, zinc phosphate treatment products, zirconium phosphate treatment products and titanium phosphate treatment products.

The undercoat chemical conversion layer is preferably present in an amount of 2 to 500 mg/m$^2$ or at a thickness of 0.002 to 0.5 μm.

The undercoat chemical conversion layer effectively enhances the adhesion of the uppercoat resinous coating layer to the aluminum-containing metal substrate and the corrosion resistance of the resultant composite material.

Where the aluminum-containing metal composite material is employed for heat exchangers, especially car air-conditioners, which are required to have a light weight, a small size and a compact structure and to exhibit a high air-blow capacity and a high heat exchange efficiency, the undercoat chemical conversion layer is preferably formed from a chemical conversion treatment liquid containing chromic acid as a main component. The chromiun containing-chemical conversion liquid is suitable for evenly treating the complicated surfaces of the heat exchanger and imparting a high corrosion resistance thereto.

The undercoat chemical conversion layer on the substrate is coated with an uppercoat resinous layer.

The uppercoat resinous layer comprises a cross-linking reaction product of:

(a) a water-soluble and cross-linkable polymeric compound having
  (i) 80 to 100 molar %, preferably 90 to 100 molar %, of a principal polymerization units each having at least one reactive functional group selected from the class consisting of amide, hydroxyl and carboxyl groups, and
  (ii) 0 to 20 molar %, preferably 0 to 10 molar %, of an additional polymerization units different from the principal polymerization units (i), with (b) a cross-linking agent reacted with the reactive functional group of the polymeric compound (a) to cross-link the molecules of the polymeric compound (a) to each other, in the presence of (c) a water-soluble polymeric compound having
  (iii) 10 to 100 molar %, preferably 20 to 100 molar %, of principal polymerization units each having at least one hydrophilic group selected from the class consisting of a sulfonic group and sulfonate groups, and
  (iv) 0 to 90 molar %, preferably 0 to 80 molar %, of additional polymerization units different from the principal polymerization units (iii).

In the uppercoat resinous layer of the present invention, it is important that in the cross-linking reaction product, the molecules of the polymeric compound (a) cross-linked with the cross-linking agent (b) be in the form of water-insoluble, three-dimensional network structures, and the molecules of the water-soluble polymeric compound (c) be held or confined in the water-insoluble, three-dimensional network structures and thereby exhibit substantially noeluting property in water.

The uppercoat resinous layer is formed by coating the surface of the undercoat chemical conversion layer with a coating liquid comprising:

(a) a water-soluble, cross-linkable polymeric compound having:
  (i) 80 to 100 molar %, preferably 90 to 100 molar %, of principal polymerization units each having at least one reactive functional group selected from the class consisting of amide, hydroxyl and carboxyl groups and
  (ii) 0 to 20 molar %, preferably 0 to 10 molar %, of additional polymerization units different from the principal polymerization units (i), (b) a cross-linking agent reactive with the reactive functional group of the polymeric compound (a), and (c) a water-soluble polymeric compound having:
  (iii) 10 to 100 molar %, preferably 20 to 100 molar %, of principal polymerization units each having at least one hydrophilic group selected from the class consisting of a sulfonic group and sulfonate groups, and
  (iv) 0 to 90 molar %, preferably 0 to 80 molar % of additional polymerization units different from the principal polymerization units (iii), and curing the coated coating liquid on the undercoat layer at a temperature of from 80° C. to 300° C., preferably from 100° C. to 250° C., to cross-link the molecules of the polymeric compound (a) to each other through residues derived from the cross-linking agent molecules, in the presence of the molecules of the water-soluble polymeric compound (c) and thereby to form an uppercoat resinous layer on the undercoat chemical conversion layer.

By the cross-linking reaction, the cross-linked molecules of the polymeric compound (a) constitute water-insoluble, three-dimensional network structures, and the molecules of the water-soluble polymeric compound (c) are held or confined in the water-insoluble, three-dimensional network structures and thereby exhibit substantially no eluting property in water.

Due to the specific water-insoluble, three dimensional network structures of the cross-linked polymeric compound (a) molecules, the molecules of the water-soluble polymeric compound (c) are caught or confined in the three dimensional network structures and thus exhibit a high resistance to elution in water.

Where the cross-linked polymeric compound molecules have strong hydrophilic groups, for example, sulfonic or sulfonate groups, the resultant three-dimensional network structures have the polymeric compound molecules having the strong hydrophilic groups and fixed to the network structures. When the outer surface of the resinous layer comes into contact with water, water is absorbed by the hydrophilic groups fixed to the network structures and penetrate into the network structures under a high osmotic pressure. The penetration of water under a high osmotic pressure causes the resinous layer to be swollen with water.

As the swelling and drying cycles are repeatedly applied to the resinous layer, it is deteriorated and finally broken.

In the specific uppercoat resinous layer of the present invention, the molecules of the water-soluble polymeric compound (c) are substantially not bounded to the network structures or are very loosely or slightly attached to the network structures, and thus form an interpenetrating network (IPN) structure together with the cross-linked molecules of the polymeric compound (a). In this network structures, the hydrophilic groups are located in the outer surface portion of the uppercoat resinous layer in a higher distribution density than that in the inside portion of the uppercoat resinous layer. Therefore, water is absorbed and held in the surface portion of the uppercoat resinous layer and does not penetrate into the inside of the uppercoat resinous layer. Therefore, the uppercoat resinous layer is substantially free from swelling with water and can exhibit a high durability in hydrophilic property and water resistance.

In the water-insoluble, cross-linkable polymeric compound (a), each additional polymerization units (ii) preferably has at least one hydrophilic group selected from the class consisting of sulfonic group and sulfonate groups, for example, sodium sulfonate and ammonium sulfonate groups.

Preferably, the water-soluble, cross-linkable polymeric compound (a) is selected from the class consisting of hompolymers of ethylenically unsaturated compounds selected from the class consisting of acrylamide, 2-hydroxyethylacrylate, acrylic acid and maleic acid, copolymers of two or more of the above-mentioned ethylenically unsaturated compounds, copolymers, of 80 molar % or more, preferably 90 to 100 molar %, of at least one member of the above-mentioned ethylenically unsaturated compounds with 20 molar % or less, preferably 10 molar % or less, of at least one additional ethylenically unsaturated compound different from the above-mentioned compounds, saponification products of polyvinyl acetate, water-soluble polyamides and water-soluble nylons.

The additional ethylenically unsaturated compound is preferably selected from ethylene, styrene, acrylic esters and methacrylic esters.

The degree of saponification of polyvinyl acetate is preferably 80 to 100%. The water-soluble polyamides are preferably selected from the class consisting of basic polyamide derived from polyalkylenepolyamines and aliphatic dicarboxylic acids, for example, adipic acid; and epoxy-modified polyamides produced by reacting the basic polyamides with epichlorohydrin.

The total amount of the hydrophilic groups derived from the polymeric compound (c) and optionally the polymeric compound (a) and the total amount of the reactive functional groups of the polymeric compound (a) in the coating liquid are preferably in a molar ratio of 0.05:1 to 2.0:1, more preferably 0.1:1 to 1.5:1.

If the molar ratio is less than 0.05:1, the resultant uppercoat resinous layer may exhibit an unsatisfactory hydrophilic property. If the molar ratio is more than 2.0:1, the resultant uppercoat resinous layer may exhibit an unsatisfactory water-resistance.

The water-soluble polymeric compound (c) is preferably selected from the class consisting of homopolymers of ethylenically unsaturated sulfonic compounds selected from the class consisting of vinylsulfonic acid, sulfoalkyl acrylates, sulfoalkyl methacrylates, 2-acrylamide-2-methylpropanesulfonic acid and salts of the above-mentioned sulfonic acids, copolymers of two or more of the above-mentioned ethylenically unsaturated sulfonic compounds, copolymers of 10 molar % or more, preferably 20 to 90 molar % of at least one member of the above-mentioned ethylenically unsaturated sulfonic compounds with 90 molar % or less, preferably 10 to 80 molar %, of at least one additional ethylenically unsaturated compound different from the ethylenically unsaturated sulfonic compound, and sulfonated phenolic resins.

The additional ethylenically unsaturated compound is preferably selected from acrylic acid, methacrylic acid, acrylamide, ethylene, styrene, acrylic esters and methacrylic esters.

The water-soluble polymeric compound (c) may be substantially not reactive with the cross-linking agent (b). Namely, in the cross-linking reaction product, the water-soluble compound (c) may be substantially not reacted with the cross-linking agent. Also, the water-soluble compound may be reacted, preferably loosely or slightly, with the cross-linking agent. In this case, preferably the additional polymerization units (iv) of the compound (c) are different from the principal polymerization units (i) of the compound (a). Where the water-soluble polymeric compound (c) has a group reactive with the cross-linking agent, the molar ratio of the hydrophilic group to the cross-linkable group is preferably 1:4 or more.

The cross-linking agent (b) usable for the present invention preferably comprises at least one member selected from the class consisting of isocyanate compounds, for example, blocked isocyanate compounds; glycidyl compounds, for example, pentaerythritol polyglycidyl ether; aldehyde compounds, for example, glyoxal, methylol compounds, for example, methylol melamine; chromium compounds, for example, chromium biphosphate, chromium nitrate and chromium sulfate; zirconium compounds, for example, zirconium ammonium carbonate; and titanium compounds, for example, hexafluorotitanic acid.

Preferably, the cross-linking agent (b) is employed in an amount sufficient to cross-link at least 10 molar % of total amount of the reactive functional groups of the polymeric compound (a).

In the production of the cross-linking product for the uppercoat resinous reaction, the water-soluble and cross-linkable polymeric compound (a), the cross-linking agent (b) and the water-soluble polymeric compound (c) are employed preferably in a weight ratio (a):(b):(c) of 100:0.05 to 100:10 to 300, more preferably 100:0.1 to 70:20 to 200.

The uppercoat resinous layer or the coating liquid for the uppercoat resinous layer optionally further comprises (d) an additional water-soluble polymeric compound held in the water-insoluble, three-dimensional network structures.

The additional water-soluble polymeric compound (d) is added to the uppercoat resinous layer for the following purposes.

(1) To decrease the softening temperature of the uppercoat resinous layer so as to enhance a close adhesion of the uppercoat resinous layer to the substrate which is in a complicated form and structure such as a heat exchanger.

(2) To enhance the resistance of the uppercoat resinous layer to cracking by reducing a stiffness of the uppercoat resinous layer.

(3) To enhance the elasticity or stretchability of the uppercoat resinous layer and to improve a follow-up property of the uppercoat resinous layer to an expansion and shrinkage of the substrate.

The additional water-soluble polymeric compound (d) is preferably selected from the class consisting of water-soluble polyamides produced from. polyethyleneglycols and polyethyleneglycol-diamines; polyacrylic resins produced by polymerizing at least one monomer selected from polyethyleneglycol acrylates and polyethyleneglycol methacrylates; polyurethane resins produced from polyethyleneglycol diisocyanates and polyols; and modified phenolic resins produced by addition-reacting phenolic resins with polyethyleneglycols.

The additional water-soluble polymeric compound is preferably contained in a content of 5 to 70%, more preferably 10 to 50%, based on the total solid weight of the uppercoat resinous layer.

The molecules of the additional water-soluble polymeric compound are also held in and restricted by the water-insoluble, three-dimensional network structures and thereby exhibit substantially no eluting property in water.

The uppercoat resinous layer or the coating liquid for the uppercoat resinous layer optionally contains an antibacterial agent having a heat-decomposing temperature of 100° C. or more, preferably 120° C. or more. Namely, the antibacterial agent substantially does not decompose at the curing temperature.

The antibacterial agent preferably comprises at least one member selected from the class consisting of:

2,2'-dithio-bis(pyridine-1-oxide), zinc pyrithione, 1,2-dibromo-2,4-dicyanobutane, 2-methyl-4-isothiazoline-3-one, 5-chloro-2-methyl-4-isothiazoline-3-one, 1,2-benzisothiazoline-3-one, 2-thiocyanomethyl-benzothiazole, and 2-pyridine-thiol-1-oxide sodium.

The antibacterial agent is employed preferably in an amount of 0.5 to 30% based on the total dry weight of the uppercoat resinous layer.

The antibacterial agent can be stably held in the water-isoluble, three dimensional network structures and effectively prevent the propagation of bacteria, fungi and yeast, over a long period.

The uppercoat resinous layer or the coating liquid for the resinous layer optionally contains a surfactant, preferably a non-ionic surfactant having a low foaming property, for example, propylene glycol-ethylene oxide addition reaction products (Pluronic, trademark), polyalkylene alcohol ethers, and polyalkylene alkylphenyl ethers.

The surfactant effectively causes the coating liquid for the uppercoat resinous layer to be uniformly distributed on the undercoat layer surface even when it has a complicated form, and an excess portion of the coating liquid applied to the undercoat layer surface to be easily removed so as to evenly coat the surface.

Also, the surfactant enhances the orientation of the hydrophilic group and the antibacterial agent toward the surface portion of the uppercoat layer.

The aluminum-containing metal material usable as a substrate of the composite material of the present invention may be in the form of a plurality of heat-exchanging tubes, which may be hollow plates, and a plurality of heat-exchanging fins extending from the heat exchanging tubes toward the outside of the tubes.

FIG. 1 shows a perspective view of an evaporator for a car air conditioner which is a type of heat exchangers.

In FIG. 1, the evaporator 1 comprises a plurality of hollow plates 2 facing each other and spaced from each other at predetermined intervals, and a plurality of fins 3 extending from the outer surfaces of the hollow plates into the gaps between the hollow plates. A cooling medium flows through the hollow plates and air is blown through the gaps between the hollow plates, as indicated by an arrow.

This type of evaporator is produced in the following manner.

A plurality of hollow plates are formed from an aluminum (A3003) or an aluminum-titanium alloy by a press-forming process, and a plurality of fins are formed from aluminum (A3003) or an aluminum-zinc alloy by a bending process.

The surfaces of the hollow plates are cladded with a brazing material (A4004 or A4343) to bond the hollow plates to each other or the fins to the hollow plates. The hollow plates and the fins are assembled in the form as shown in FIG. 1, they are bonded to each other by a conventional brazing method, for example, a vacuum brazing method or an atmosphere brazing method to form a drawn cup type of evaporator substrate. Then the resultant evaporator substrate is subjected to the process of the present invention to coat the substrate surface with an undercoat chemical conversion layer and then with an uppercoat resinous layer.

Figure 2:
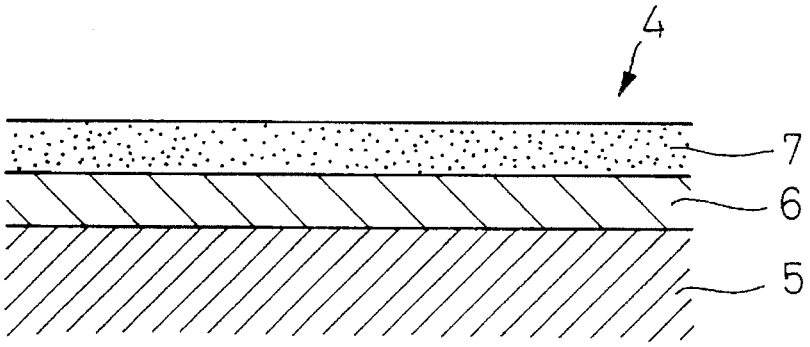
FIG. 2 is an explanatory cross-sectional profile of an embodiment of the aluminum-containing metal composite material of the present invention.

FIG. 2 shows a cross-sectional profile of an embodiment of the aluminum-containing metal composite material of the present invention.

In FIG. 2, a composite material 4 comprises a substrate 5, an undercoat chemical conversion layer 6 formed on the substrate 5 and an uppercoat resinous layer 7 formed on the undercoat layer.

In the composite material of the present invention, the substrate is briefly protected by the undercoat chemical conversion layer which may have pinholes, and further protected by the uppercoat resinous layer which completely closes the pinholes.

Figure 3:
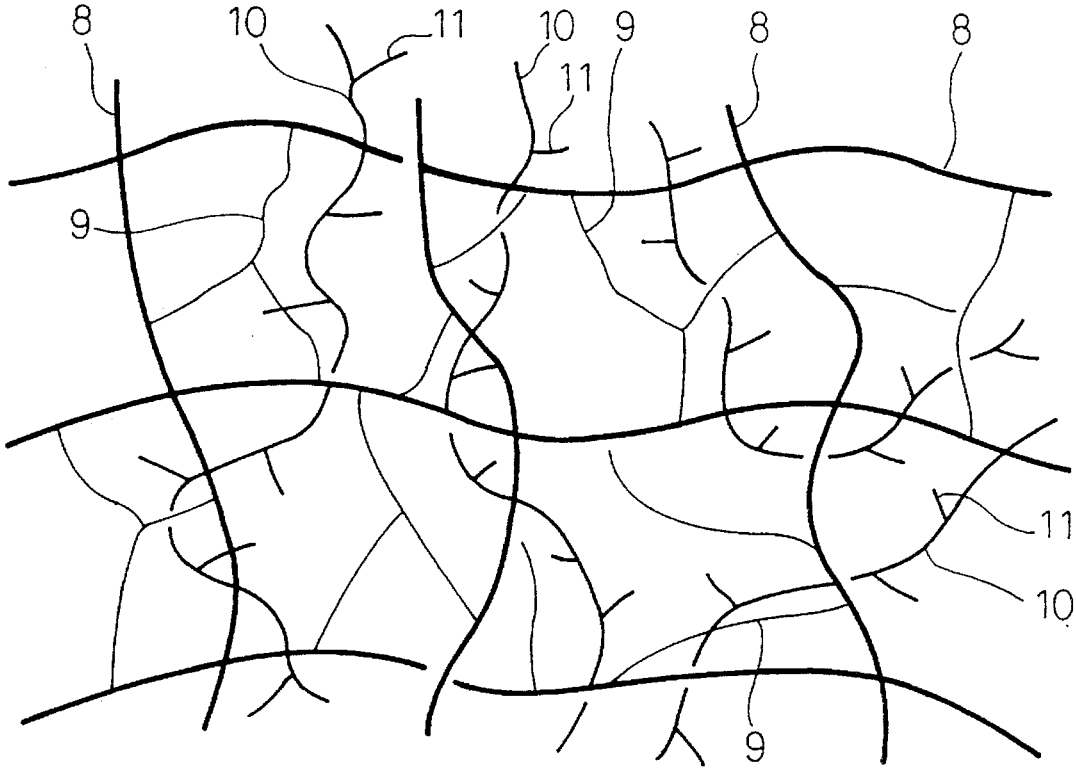
FIG. 3 shows an explanatory model of three-dimentional network structures of the uppercoat resinous layer of the present invention.

FIG. 3 is an explanatory model view of the cross-linked molecular structure of the uppercoat resinous layer of the present invention.

In FIG. 3, a plurality of polymeric compound molecules 8 are cross-linked with a plurality of cross-linkages 9 so as to form a three-dimensional network structure, and a plurality of water-soluble polymeric compound molecules 10 having hydrophilic groups 11 are entangled with the cross-linked molecules 8 and held in the three-dimensional network structure. Therefore, the elution of the water-soluble polymeric compound molecules 10 in water is obstructed by the three dimensional network structure of the cross-linked polymeric compound molecules 8.

Figure 4:
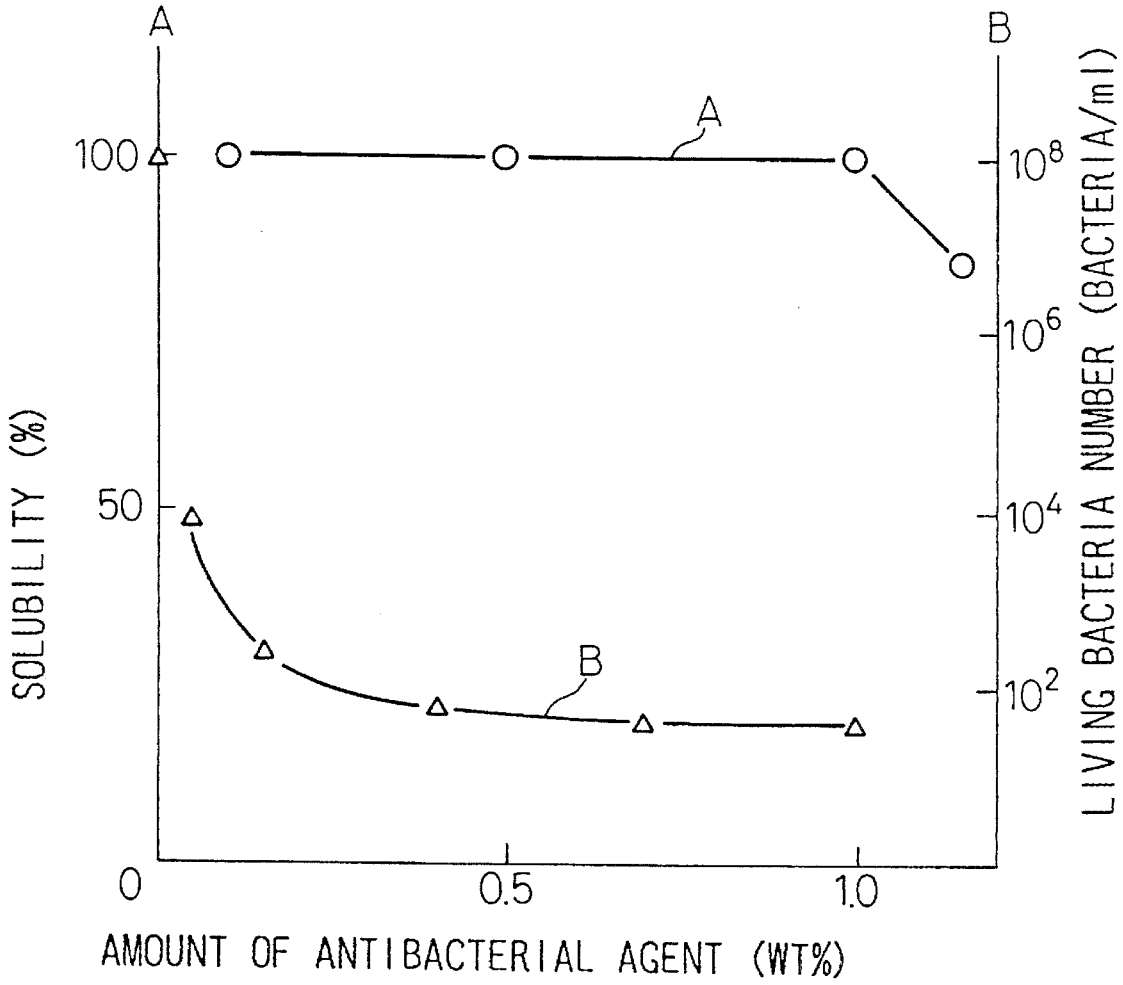
FIG. 4 is a graph showing effects of an antibacterial agent contained in an uppercoat resinous layer of the present invention.

FIG. 4 shows a relationship between the content of an antibacterial agent in the uppercoat resinous layer and solubility of the antibacterial agent in water and a relationship between the content of the antibacterial agent and the number of living bacteria on the uppercoat resinous layer.

EXAMPLES

The present invention will be further explained by the following examples.

Example 1

A heat exchanger as shown in FIG. 1 was used as a substrate.

A chromic acid-chromate chemical conversion treating liquid (available under the trademark of Alchrom 20A, from Nihon Parkerizing K.K.) was diluted with water to a concentration of 72 g/liter.

The chemical conversion treatment solution was heated at a temperature of 50° C., and the substrate was immersed in the treatment solution for 2 minutes so as to form an undercoat chemical conversion layer in an amount of 100 $mg/m^2$ in terms of chromium.

Then, a coating liquid for an uppercoat resinous layer was prepared by dissolving 2% by weight of a mixture comprising 100 parts by weight of polyacrylamide, 100 parts by weight of polyvinyl sulfonic acid, 15 parts by weight of a cross-linking agent consisting of chromium biphosphate, 10 parts by weight of an antibacterial agent consisting of 2,2'-dithio-bis(pyridine-1-oxide) and 5 parts by weight of a non-ionic surfactant (available under the trademark of Noigen ET135, from Daiichikogyoseiyaku K.K.) in water.

The chemical conversion-treated substrate was immersed in the coating liquid at a temperature of 25° C. for 0.5 minute, and then removed from the coating liquid. An air-blow treatment was applied to the coating liquid-coated substrate under an air pressure of 3 $kg/cm^2$ for 40 seconds to remove an excessive amount of the coating liquid from the substrate. The coating liquid layer on the undercoat layer was cured in a hot air dryer at a temperature of 140° C. for about 8 minutes to form an uppercoat resinous layer.

The resultant uppercoat resinous layer had a thickness of 0.5 μm.

Example 2

The same procedures as in Example 1 were carried out with the following exceptions.

The chemical conversion treatment solution was prepared by dissolving a phosphoric acid-chromate chemical conversion treatment liquid (available under the trademark of ALCHROM 701, from Nihon Paskerizing K.K.) in a concentration of 30 g/liter in water, and heated at a temperature of 50° C. The substrate (heat exchanger substrate as shown in FIG. 1) was immersed in the chemical conversion treatment solution for 0.5 minute to form an undercoat chemical conversion layer on the substrate.

A coating solution for the uppercoat resinous layer was prepared by dissolving a mixture of 100 parts by weight of a water-soluble nylon (available under the trademark of WATER-SOLUBLE-NYLON P-70, from Toray), 200 parts by weight of a copolymer of 20 molar % of acrylic acid with 80 molar % of sulfoethyl acrylate, 100 parts by weight of a cross-linking agent consisting of pentaerythritol polyglicidyl-ether, 20 parts by weight of an antibacterial agent consisting of zinc pyrithione and 5 parts by weight of a non-ionic surfactant (available under the trademark of NEWPOL PE-62, from Sanyo Kasei K.K.), in a concentration of 2% by weight in water.

The uppercoat resinous layer was formed from the coating solution on the undercoat chemical conversion layer.

Example 3

The same procedures as in Example 1 were carried out with the following exception.

The chemical conversion treatment solution was prepared by dissolving a zirconium phosphate chemical conversion treatment liquid (available under the trademark of ALOGIN 4040, from Nihon Parkerizing K.K.) in a concentration of 20 g/liter in water, and heated at a temperature of 40° C. The substrate (heat-exchanger substrate as shown in FIG. 1) was immersed in the chemical conversion treatment solution for 0.5 minute to form an undercoat chemical conversion layer on the substrate.

A coating solution for the uppercoat resinous layer was prepared by dissolving a mixture of 100 parts by weight of a 90% saponification product of polyvinyl acetate, 100 parts by weight of a copolymer of 60 molar % of methacrylic acid with 20 molar % of sulfoethyl acrylate, 100 parts by weight of a cross-linking agent consisting of blocked isocyanate (available under the trademark of ELASTOLON W-11, from Daiichi Kogyoseiyaku K.K.), 15 parts by weight of an antibacterial agent consisting of 1,2-dibromo-2,4,-dicyanobutane and 5 parts by weight of a non-ionic surfactant (available under the trademark of NEWPOL PE-62), in a concentration of 2% by weight in water.

The uppercoat resinous layer was formed from the coating solution on the undercoat chemical conversion layer.

Example 4

The same procedures as in Example 1 were carried out with the following exceptions.

The chemical conversion treatment was the same as in Example 1.

The coating solution for the uppercoat resinous layer was prepared by dissolving a mixture of 100 parts by weight of a copolymer of 90 molar % of acrylamide with 10 molar % of sodium salt of 2-acrylamide-2-methylpropanesulfonic acid, 100 parts by weight of polyvinylsulfonic acid, 50 parts by weight of a cross-linking agent consisting of zirconium ammonium carbonate, 10 parts by weight of an antibacterial agent consisting of a mixture of 2-methyl-4-isothiazoline-3-one with 5-chloro-2-methyl-4-isothiazoline-3-one in a mixing weight ratio of 1:1, and 5 parts by weight of a non-ionic surfactant (available under the trademark of NEWPOL PE62), in a concentration of 3% by weight in water.

The uppercoat resinous layer was formed from the coating solution on the undercoat chemical conversion layer.

Example 5

The same procedures as in Example 1 were carried out with the following exceptions.

The chemical conversion treatment was the same as in Example 1.

The coating solution for the uppercoat resinous layer was prepared by dissolving a mixture of 100 parts by weight of polyacrylamide, 100 parts by weight of a copolymer of 60 molar % of methacrylic acid with 40 molar % of sulfoethyl acrylate, 3 parts by weight of a cross-linking agent consisting of chromium nitrate, 10 parts by weight of an antibacterial agent consisting of 1,2-benzisothiazoline-3-one, and 5 parts by weight of a non-ionic surfactant (available under the trademark of ADECANOL B4001, from Asahi Denkakogyo K.K.), in a concentration of 2% by weight in water.

The uppercoat resinous layer was formed from the coating solution on the undercoat chemical conversion layer.

Example 6

The same procedures as in Example 1 were carried out with the following exceptiones.

The chemical conversion treatment was the same as in Example 1.

The coating solution for the uppercoat resinous layer was prepared by dissolving a mixture of 100 parts by weight of polyacrylamide, 80 parts by weight of a water-soluble nylon (available under the trademark of WATER-SOLUBLE-NYLON P-70, from Toray), 50 parts by weight of polyvinylsulfonic acid, 15 parts by weight of a cross-linking agent consisting of chromium sulfate, 10 parts by weight of an antibacterial agent consisting of 2-thiocyanomethyl benzothiazole and 5 parts by weight of a non-ionic surfactant (available under the trademark of NOIGEN ET135), in a concentration of 2% by weight in water.

The uppercoat resinous layer was formed from the coating solution on the undercoat chemical conversion layer.

Example 7

The same procedures as in Example 1 were carried out with the following exceptions.

The chemical conversion treatment was the same as in Example 2.

The coating solution for the uppercoat resinous layer was prepared by dissolving a mixture of 100 parts by weight of polyacrylamide, 150 parts by weight of a terpolymer of 70 molar % of acrylic acid with 10 molar % of sodium methacrylate and 20 molar % of sulfoethyl methacrylate sodium salt, 100 parts by weight of a cross-linking agent consisting of zirconium ammonium carbonate, 20 parts by weight of an antibacterial agent consisting of 2-pyridine-thiol-1-oxide sodium, and 5 parts by weight of a non-ionic surfactant (available under the trademark of NOIGEN ET135), in a concentration of 2% by weight in water.

The uppercoat resinous layer was formed from the coating solution on the undercoat chemical conversion layer.

Example 8

The same procedures as in Example 1 were carried out with the following exceptions.

The chemical conversion treatment was the same as in Example 2.

The coating solution for the uppercoat resinous layer was prepared by dissolving a mixture of 100 parts by weight of polyvinyl-alcohol (available under the trademark of Gosefimer Z100, from Nihon Gosei K.K.), 100 parts by weight of a terpolymer of 20 molar % of 2-hydroxyethyl acrylate with 30 molar % of sodium 2-acrylamide-2-methylpropanesulfonate and 50 molar % of sodium acrylate, 50 parts by weight of a cross-linking agent consisting of sorbitol polyglycidyl-ether, 12 parts by weight of an antibacterial agent consisting of zinc pyrithione and 5 parts by weight of a non-ionic surfactant (available under the trademark of Adecanol B4001), in a concentration of 1% by weight in water.

The uppercoat resinous layer was formed from the coating solution on the undercoat chemical conversion layer.

Comparative Example 1

The same procedures as in Example 1 were carried out with the following exceptions.

The chemical conversion treatment was omitted.

In the coating solution for the uppercoat resinous layer, the antibacterial agent consisting of 2,2'-dithio-bis(pyridine-1-oxide) was not contained.

The uppercoat resinous layer was formed directly on the substrate.

Comparative Example 2

The same procedures as in Example 2 were carried out with the following exceptions.

The same chemical conversion treatment in Example 2 was carried out, and the resultant product was heat treated in a hot air dryer at a temperature of 140° C. for 8 minute.

No uppercoat resinous layer was formed on the chemical conversion layer.

Comparative Example 3

The same procedures as in Example 5 were carried out with the following exceptions.

In the coating solution for the uppercoat resinous layer, the cross-linking agent consisting of chromiun nitrate and the non-ionic surfactant were contained.

The uppercoat resinous layer was formed from the coating solution on the undercoat chemical conversion layer.

Comparative Example 4

The same procedures as in Example 1 were carried out with the following exceptions.

The chemical conversion treatment was the same as in Example 1.

The coating solution for the uppercoat resinous layer was prepared by dissolving a mixture of 100 parts by weight of polyvinylsulfonic acid, 15 parts by weight of a cross-linking agent consisting of chromium biphosphate ether, 10 parts by weight of an antibacterial agent consisting of 2,2'-dithio-bis(pyridine-1-oxide) and 5 parts by weight of a non-ionic surfactant (available under the trademark of NOIGEN ET135), in a concentration of 2% by weight in water.

The uppercoat resinous layer was formed from the coating solution on the undercoat chemical conversion layer.

The types of the chemical conversion treatments and the components in the coating liquids for the uppercoat resinous layers of Examples 1 to 8 and Comparative Examples 1 to 4 are shown in Tables 1 and 2.

TABLE 1

| | Item | | |
|---|---|---|---|
| | Undercoat layer | Uppercoat layer | |
| Example No. | Type of chemical conversion treatment | Components in coating liquid $(*)_1$ | Molar ratio $(*)_2$ |
| Example | | | |
| 1 | Chromic acid-chromate | Polyacrylamide<br>Polyvinylsulfonic acid<br>Chromium biphosphate<br>2,2'-dithio-bis(pyridine-1-oxide)<br>Non-ionic surfactant | 0.55 |
| 2 | Phosphoric acid-chromate | Water-soluble nylon<br>Acrylic acid (20 mol %)-sulfoethyl acrylate (80 mol %) copolymer<br>Pentaerithritol polyglycidyl ether<br>Zinc pyrithione<br>Non-ionic surfactant | 1.43 |
| 3 | Zirconium phosphate | 90% saponification product of polyvinyl acetate<br>Methacrylic acid (60 mol %)-sulfoethyl acrylate (40 mol %) copolymer<br>Blocked isocyanate<br>1,2-dibromo-2,4-dicyanobutane<br>Non-ionic surfactant | 0.12 |
| 4 | Chromic acid-chromate | Acrylamide (90 mol %)-sodium 2-acrylamide-2-methylpropane-sulfonate copolymer<br>Polyvinylsulfonic acid<br>Zinconium ammonium carbonate<br>Mixture of 2-methyl-4-isothiazoline-3-one with 5-chloro-2-methyl-4-isothiazoline-3-one<br>Non-ionic surfactant | 0.85 |
| 5 | Chromic acid-chromate | Polyacrylamide<br>Methacrylic acid (60 mol %)-sulfoethyl acrylate (40 mol %) copolymer<br>Chromium nitrate<br>1,2-benzthiazoline-3-one<br>Non-ionic surfactant | 0.17 |
| 6 | Chromic acid-chromate | Polyacrylamide<br>Water-soluble nylon<br>Polyvinylsulfonic acid<br>Chromium sulfate<br>2-Thiocyanomethyl benzothiazole<br>Non-ionic surfactant | 0.33 |
| 7 | Phosphoric acid-chromate | Polyacrylamide<br>Acrylic acid (70 mol %)-sodium methacrylate (10 mol %)-sulfoethyl methacrylate Na salt (20 mol %) terpolymer<br>Zirconium ammonium carbonate<br>2-pyridine-thiol-1-oxide sodium<br>Non-ionic surfactant | 0.22 |
| 8 | Phosphoric acid-chromate | Polyvinyl alcohol<br>2-Hydroxyethyl acrylate (20 mol %)-Na 2-acrylamide-2-methylpropanesulfonate (30 mol %)-Na acrylate-terpolymer<br>Sorbitol polyglycidyl ether<br>Zinc pyrithione<br>Non-ionic surfactant | 0.10 |

TABLE 1-continued

| Example No. | Item: Undercoat layer Type of chemical conversion treatment | Uppercoat layer: Components in coating liquid $(*)_1$ | Uppercoat layer: Molar ratio $(*)_2$ |
|---|---|---|---|

Note:
$(*)_1$Coating liquid temperature: 25° C.,
Immersion time: 0.5 min
Drying (Curing): 140° C. × 8 min
$(*)_2$Molar ratio of hydrophilic group to reactive functional group

TABLE 2

| Comparative Example No. | Item: Undercoat layer Type of chemical conversion treatment | Uppercoat layer: Components of coating liquid $(*)_1$ | Uppercoat layer: Molar ratio $(*)_2$ |
|---|---|---|---|
| Comparative Example Number | | | |
| 1 | None | The same as in Example 1, except that 2,2'-dithio-bis-(pyridine-1-oxide) was omitted. | 0.55 |
| 2 | The same as in Example 2 | None | — |
| 3 | The same as in Example 5 | The same as in Example 5, except that chromium sulfate and non-ionic surfactant were omitted. | 0.17 |
| 4 | Chromic acid-chromate | Polyvinylsulfonic acid<br>Chromium biphosphate<br>2,2'-dithio-bis(pyridine-1-oxide)<br>Non-ionic surfactant | — |

TESTS

The resultant surface-coated heat exchangers of Examples 1 to 8 and Comparative Examples 1 to 4 were subjected to the following tests.

(1) Measurement of excessive adhesion number

After the under layer-coated substrate was immersed in the coating solution for the uppercoat resinous layer, the substrate was taken up from the coating solution and air was blown toward the coating solution-coated substrate to remove an excess amount of the coating liquid. During the air-blow operation, the number N of portions of the substrate surface in which an excess amount of the coating liquid was located, was counted, and the counted number N was divided by the number n of the gaps between the fins. The excessive adhesion number was represented by a product of the calculated quotient N/n and 100.

(2) Retension of uppercoat resinous layer

The coated product was immersed in tap water for one week while flowing the tap water. This operation will be referred to as an immersion test in flowing water hereinafter. This test corresponds to a 60,000 km running experience of car, and to an experimental reproduction of an aluminum heat-exchanger practically used for 5 to 6 years.

After the immersion test, the amount of the uppercoat resinous layer remaining on the heat-exchanger surface was measured.

The retention of the uppercoat resinous layer was represented by a percentage of the measured amount of the immersion tested uppercoat resinous layer based on the amount of the non-immersion tested uppercoast resinous layer.

(3) Resistance to Water Swelling

The surface-coated heat exchanger was immersed in flowing water and removed from the flowing water. Then, the fin surfaces were lightly rubbed with a cotton gauze, to determine whether the uppercoat layer was removed. The test results are classified as follows.

| Class | Result |
|---|---|
| 2 | The uppercoat layer is not removed. |
| 1 | The uppercoat layer is removed. |

(4) Odor-generation

The surface coated heat exchanger was mounted on a car and actually driven. The odor generated by the heat exchanger was organoleptically tested by 5 persons (panellists). The test results are classified as follows.

| Class | Odor |
|---|---|
| 0 | No odor |
| 1 | Very slight odor |
| 2 | Slight odor |
| 3 | Certain odor |
| 4 | Strong odor |
| 5 | Very strong odor |

(5) Hydrophilic property

After the immersion test in flowing water, fins were cut from the tested heat exchanger, and a water contact angle of a water drop on the fin surface was measured by using a Gonio type contact angle tester.

(6) Antibacterial property

After the immersion test in flowing water, a mixture of bacteria, fungi or yeast with a culture medium was adhered to the surface of the immersion tested heat exchanger, and left to stand at room temperature for 14 days. Then, the number of the living microbe (bacteria, fungi or yeast) was counted.

The microbe (bacteria, fungi and yeast) used. for this test were collected from practically used heat exchangers (no antibacterial agent was applied) and propagated.

The bacteria, fungi and yeast used in this test were as follows.

Bacteria:
*Bacillus subtilis,*
*Pseudomanos aeruginosa,*
Acinetobacter,
Enterobacter sp.,
Alcaligenes sp.,
*Escherishia coli*

Fungi:
*Aspergillus niger,*
Alternalia sp.,
*Penicillium Citrinum,*
Cladosporium sp.,
Aureobasidium sp., Penicillium sp.,
Asergillus sp., Yeast:
Saccharomyces sp.,
Phodotolura sp.

To confirm the effect of the uppercoat resinous layer on the prevention of the bad odor-generation due to the propagation of the microbe, the microbe-cultured heat exchanger was subjected to an organoleprical test by five persons (panellists). The test results were classified as follows.

| Class | Nature of odor |
|---|---|
| +1 | Pleasant |
| 0 | Not pleasant but not unpleasant |
| −1 | Slightly unpleasant |
| −2 | Certainly unpleasant |
| −3 | Very unpleasant |
| −4 | Extremely unpleasant |

The test results of Examples 1 to 8 and Comparative Examples 1 to 4 are shown in Table 3.

Also, with respect to the surface-coated heat. exchanger of Example 1, the relationships between the content of the antibacterial agent in the uppercoat resinous layer and the solubility (A) of the antibacterial agent in water and the living bacteria number (B) are shown in FIG. 4.

TABLE 3

| Example No. | Excessive adhere number (%) | Retention of uppercoat resinous layer (%) | Resistance to water swelling | Odor-generation | Water contact angle (degree°) | Antibacterial property: Bacteria number (bacteria/ml) Bacteria | Fungi | Yeast | Nature of odor |
|---|---|---|---|---|---|---|---|---|---|
| Example | | | | | | | | | |
| 1 | <1 | 80 | 2 | <1 | 17 | 23 | 7 | 65 | 0 |
| 2 | <1 | 75 | 2 | <1 | 18 | 31 | 13 | 70 | 0 |
| 3 | <1 | 75 | 2 | <1 | 18 | 33 | 10 | 55 | 0 |
| 4 | <1 | 80 | 2 | <1 | 17 | 20 | 8 | 52 | 0 |
| 5 | <1 | 80 | 2 | <1 | 15 | 18 | 10 | 72 | 0 |
| 6 | <1 | 80 | 2 | <1 | 19 | 24 | 71 | 55 | 0 |
| 7 | <1 | 75 | 2 | <1 | 17 | 45 | 23 | 20 | 0 |
| 8 | <1 | 75 | 2 | <1 | 20 | 15 | 31 | 35 | 0 |
| Comparative Example | | | | | | | | | |
| 1 | <1 | 50 | 2 | 2.0 Stimulative odor | 25 | $3.0 \times 10^5$ | $1.9 \times 10^5$ | $8.8 \times 10^5$ | −3 |
| 2 | <1 | — | 2 | 3.5 Stimulative odor | 63 | $4.5 \times 10^5$ | $2.2 \times 10^5$ | $7.5 \times 10^5$ | −3 |
| 3 | 15 | 5 | 1 (Dissolved) | 2.5 Stimulative odor | 55 | $2.2 \times 10^2$ | $3.2 \times 10^2$ | $4.5 \times 10^2$ | −3 |
| 4 | <1 | 0 | 1 (Dissolved) | 3.5 Stimulative odor | 62 | $1.8 \times 10^5$ | $7.2 \times 10^5$ | $8.5 \times 10^5$ | −3 |

As Table 3 clearly indicates, the heat exchangers of Examples 1 to 8, which were surface-coated in accordance with the present invention, exhibited a satisfactory resistance to local excessive adhesion of the coating solution for the uppercoat layer, a high retention of the uppercoat layer, an excellent resistance to water-swelling, a high resistance to bad order-generation, a high hydrophilic property, and excellent antibacterial property, and thus had an excellent durability in practical use over a long period.

In the surface-coated heat exchanger of Comparative Example 1 having no undercoat chemical conversion layer, it was found that the aluminum substrate was corroded during the immersion test in flowing water, thus the uppercoat resinous layer was partially removed from the substrate surface, and a bad odor was generated. Also, due to the lack of the antibacterial agent, the uppercoat resinous layer allowed the bacteria, fungi or yeast to propagage.

In the surface-coated heat exchanger of Comparative Example 2 having no uppercoat resinous layer, the hydrophilic property, the resistance to bad odor generation and the antibacterial property were unsatisfactory.

In the surface-coated heat exchanger of Comparative Example 3 in which the uppercoat resinous layer contained no cross-linking agent and non-ionic surfactant, the uppercoat layer exhibited a poor water resistance and hydrophilic property and an unsatisfactory resistance to bad odor generation and antibacterial property, due to the lack of the cross-linking agent. Also, due to the lack of the non-ionic surfactant, the coating liquid for the uppercoat layer was unevenly adhered to the surface of the heat exchanger and it was difficult to make the distribution of the coating liquid uniform throughout the surface of the heat exchanger.

In the surface-coated heat exchanger of Comparative Example 4 in which the coating liquid for the uppercoat resinous layer contained no cross-linkable polymeric material, the resultant uppercoat resinous layer exhibited a poor water-resistance, and an unsatisfactory hydrophilic property, resistance to bad odor generation and antibacterial property.

We claim:

1. An aluminum-containing metal composite material comprising:

(A) a substrate comprising an aluminum containing metal material;

(B) an undercoat chemical conversion layer formed on the substrate; and (C) an uppercoat resinous layer formed on the undercoat chemical conversion layer and comprising a cross-linking reaction product of (a) a water-soluble and cross-linkable polymeric compound having (i) 80 to 100 molar % of principal polymerization units each having at least one reactive functional groups selected from the class consisting of amide, hydroxyl and carboxyl groups and (ii) 0 to 20 molar % of additional polymerization units different from the principal polymerization units (i), with (b) a cross-linking agent reacted with the reactive functional group of the polymeric compound (a) to cross-link the molecules of the polymeric compound (a) to each other, in the presence of (c) a water-soluble polymeric compound having (iii) 10 to 100 molar % of principal polymerization units each having at least one hydrophilic group selected from the class consisting of sulfonic group and sulfonate groups and (iv) 0 to 90 molar % of additional polymerization units different from the principal polymerization unit (iii), in the cross-linking reaction product, the molecules of the polymeric compound (a) cross-linked with the cross-linking agent (b) forming water-insoluble three-dimensional network structures, and the molecules of the water-soluble polymeric compound (c) being held in the water-insoluble, three-dimensional network structures and thereby exhibiting substantially no eluting property in water.

2. The aluminum-containing metal composite material as claimed in claim 1, wherein the undercoat chemical conversion layer comprises at least one member selected from the class consisting of chromic acid-chromate treatment products, phosphoric acid-chromate treatment products, zinc phosphate treatment products, zirconium phosphate treatment products, and titanium phosphate treatment products.

3. The aluminum-containing metal composite material as claimed in claim 1, wherein the additional polymerization units (ii) of the water-soluble and cross-linkable polymeric compound (a) each have at least one hydrophilic group selected from the class consisting of sulfonic group and sulfonate groups.

4. The aluminum-containing metal composite material as claimed in claim 1, wherein the water-soluble and cross-linkable polymeric compound (a) is selected from the class consisting of homopolymers of ethylenically unsaturated compounds selected from the class consisting of acrylamide, 2-hydroxyethylacrylate, acrylic acid and maleic acid, copolymers of two or more of the above-mentioned ethylenically unsaturated compounds, copolymers of 80 molar % or more of at least one member of the above-mentioned ethylenically unsaturated compounds with 20 molar % or less of at least one additional ethylenically unsaturated compound different from the above-mentioned compounds, saponification products of polyvinyl acetate, water-soluble polyamides and water-soluble nylons.

5. The aluminum-containing metal composite material as claimed in claim 1, wherein the total amount of the hydrophilic group and the total amount of the reactive functional group of the polymeric compounds (a) and (c) are in a molar ratio of 0.05 to 2.0.

6. The aluminum-containing metal composite material as claimed in claim 1, wherein the water soluble polymeric compound (c) is selected from the class consisting of homopolymers of ethylenically unsaturated sulfonic compounds selected from the class consisting of vinylsulfonic acid, sulfoalkyl acrylates, sulfoalkyl methacrylates 2-acrylamide-2-methylpropanesulfonic acid and salts of the above-mentioned sulfonic acids, copolymers of two or more of the above-mentioned ethylenically unsaturated sulfonic compounds, copolymers of 10 molar % or more of at least one member of the above-mentioned ethylenically unsaturated sulfonic compounds with 90 molar % or less at least one additional ethylenically unsaturated compound different from the ethylenically unsaturated sulfonic compound, and sulfonated phenolic resins.

7. The aluminum-containing metal composite material as claimed in claim 1, wherein the water soluble polymeric compound (c) is substantially not reacted with the cross-linking agent (b).

8. The aluminum-containing metal composite material as claimed in claim 1, wherein the additional polymerization units (iv) of the water soluble polymeric compound (c) are different from the principal polymerization units (i) of the water-soluble and cross-linkable polymeric compound (a).

9. The aluminum-containing metal composite material as claimed in claim 1, wherein the cross-linking agent (b) comprises at least one member selected form the class consisting of isocyanate compounds, glycidyl compounds, aldehyde compounds, methylol compounds, chromium compounds, zirconium compounds and titanium compounds.

10. The aluminum-containing metal composite material as claimed in claim 1, wherein in the production of the cross-linking reaction product for the uppercoat resinous layer, the water-soluble and cross-linkable polymeric compound (a), the cross-linking agent (b) and the water-soluble polymeric compound (c) are employed in a weight ratio (a):(b):(c) of 100:0.05 to 100:10 to 300.

11. The aluminum-containing metal composite material as claimed in claim 1, wherein the uppercoat resinous layer further comprises (d) an additional water-soluble polymeric compound selected from the class consisting of water-soluble polyamides produced from polyethyleneglycols and polyethyleneglycoldiamines; polyacrylic resins produced by polymerizing at least one monomer selected from the class consisting of polyethyleneglycol acrylates and polyethyleneglycol methacrylates; polyurethane resins produced from polyethyleneglycol diisocyanates and polyols; and modified phenolic resins produced by addition-reacting phenolic resins with polyethyleneglycols.

12. The aluminum-containing metal composite material as claimed in claim 1, wherein the uppercoat resinous layer further comprises an antibacterial agent having a heat-decomposing temperature of 100° C. or more.

13. The aluminum-containing metal composite material as claimed in claim 10, wherein the antibacterial agent comprises at least one member selected from the class consisting of 2,2'-dithio-bis(pyridine-1-oxide), zinc pyrithione, 1,2-dibromo-2,4-dicyanobutane, 2-methyl-4-isothiazoline-3-one, 5-chloro-2-methyl-4-isothiazoline-3-one, 1,2-benzisothiazoline-3-one, 2-thiocyanomethyl-benzothiazole and 2-pyridine-thiol-1-oxide sodium.

14. The aluminum-containing metal composite material as claimed in claim 1, wherein the uppercoat resinous layer further comprises a non-ionic surfactant.

15. A process for producing an aluminum-containing metal composite material, comprising the steps of:

(A) applying a chemical conversion treatment to a surface of a substrate comprising an aluminum-containing metal material to form an undercoat chemical conversion layer on the substrate; and (B) coating the surface of the undercoat chemical conversion layer with a coating liquid comprising:

(a) a water-soluble and cross-linkable polymeric compound having (i) 80 to 100 molar % of principal polymerization units each having at least one reactive functional group selected from the class consisting of amide, hydroxyl and carboxyl groups and (ii) 0 to 20 molar % of additional polymerization units different from the principal polymerization units (i), (b) a cross-linking agent reactive with the reactive functional group of the polymeric compound (a), and (c) a water-soluble polymeric compound having (iii) 10 to 100 molar % of principal polymerization units each having at least one hydrophilic group selected from the class consisting of sulfonic group and sulfonate groups and (iv) 0 to 10 molar % of additional polymerization units different from the principal polymerization units (iii), (C) curing the coated coating liquid on the undercoat layer at a temperature of from 80° C. to 300° C., to cross-link the molecules of the polymeric compound (a) to each other with the cross-linking agent (b) in the presence of the polymeric compound (c) and thereby to from an uppercoat resinous layer on the undercoat chemical conversion layer, in the cross-linking reaction, the molecules of the polymeric compound (a) cross-linked with the cross-linking agent (b) forming water-insoluble, three-dimensional network structures, and the molecules of the water-soluble polymeric compound (c) being held in the water-insoluble, three-dimensional network structures and thereby exhibiting substantially no eluting property in water.

16. The process as claimed in claim 15, wherein the undercoat chemical conversion treatment is selected from the class consisting of chromic acid-chromate treatments, phosphoric acid-chromate treatments, zinc phosphate treatments, zirconium phosphate treatments and titanium phosphate treatments.

17. The process as claimed in claim 15, wherein the additional polymerization units (ii) of the polymeric compound (a) each have a hydrophilic group selected from the class consisting of sulfonic group and sulfonate groups.

18. The process as claimed in claim 15, wherein the water-soluble and cross-linkable polymeric compound (a) is selected from the class consisting of homopolymers of ethylenically unsaturated compound selected from the class consisting of acrylamide, 2-hydroxyethylacrylate, acrylic acid, maleic acid, copolymers of two or more of the above-mentioned ethylenically unsaturated compounds, copolymers of 80 molar % or more of at least one member of the above-mentioned ethylenically unsaturated compounds with 20 molar % or less of at least one additional ethylenically unsaturated compound different from the above-mentioned compounds, saponification products of polyvinyl acetate, water-soluble polyamides and water-soluble nylons.

19. The process as claimed in claim 15, wherein the total amount of the hydrophilic group and the total amount of the reactive functional group of the polymeric compounds (a) and (c) are in a molar ratio of 0.05 to 2.0.

20. The process as claimed in claim 15, wherein the water soluble polymeric compound (c) is selected from the class consisting of homopolymers of ethylenically unsaturated sulfonic compounds selected from the class consisting of vinylsulfonic acid, sulfoalkyl acrylates, sulfoalkyl methacrylates 2-acrylamide-2-methylpropanesulfonic acid and salts of the above-mentioned sulfonic acids, copolymers of two or more of the above-mentioned sulfonic compounds, copolymers of 10 molar % or more of at least one member of the above-mentioned ethylenically unsaturated sulfonic compounds with 90 molar % or less of at least one additional ethylenically unsaturated compound different from the ethylenically unsaturated sulfonic compound, and sulfonated phenolic resins.

21. The process as claimed in claim 15, wherein the water soluble polymeric compound (c) does substantially not react with the cross-linking agent (b).

22. The process as claimed in claim 15, wherein the additional polymerization units (iv) of the water-soluble polymeric compound (c) are different from the principal polymerization units (i) of the water-soluble and cross-linkable polymeric compound (a).

23. The process as claimed in claim 15, wherein the cross-linking agent (b) comprises at least one member selected from the class consisting of isocyanate compounds, glycidyl compounds, aldehyde compounds, methylol compounds, chromium compounds, zirconium compounds and titanium compounds.

24. The process as claimed in claim 15, wherein in the coating liquid for the uppercoat resinous layer, the water-soluble and cross-linkable polymeric compound (a), the cross-linking agent (b) and the water-soluble polymeric compound (c) are contained in a weight ratio (a):(b):(c) of 100:0.05 to 100:10 to 300.

25. The process as claimed in claim 15, wherein the coating liquid for the uppercoat resinous layer further comprises (d) an additional water-soluble polymeric compound selected from the class consisting of water-soluble polyamides produced from polyethyleneglycols and polyethyleneglycoldiamines; polyacrylic resins produced by polymerizing at least one monomer selected from the class consisting of polyethyleneglycol acrylates and polyethyleneglycol methacrylates; polyurethane resins produced from polyethyleneglycol diisocyanates and polyols; and modified phenolic resins produced by addition-reacting phenolic resins with polyethyleneglycols.

26. The process as claimed in claim 15, wherein the coating liquid for the uppercoat resinous layer further comprises an antibacterial agent having a heat-decomposing temperature of 100° C. or more.

27. The process as claimed in claim 26, wherein the antibacterial agent comprises at least one member selected from the class consisting of 2,2'-dithio-bis(pyridine-1-oxide), zinc pyrithione, 1,2-dibromo-2,4-dicyanobutane, 2-methyl-4-isothiazoline-3-one, 5-chloro-2-methyl-4-isothiazoline-3-one, 1,2-benzisothiazoline-3-one, 2-thiocyanomethyl-benzothiazole, and 2-pyridine-thiol-1-oxide sodium.

28. The process as claimed in claim 15, wherein the coating liquid for the uppercoat resinous layer further comprises a non-ionic surfactant.

29. The process as claimed in claim 15, wherein the substrate is the form of a heat-exchanger having a plurality of heat-exchanging tubes and a plurality of heat-exchanging fins extending from the heat-exchanging tubes.

30. A heat-exchanger having a plurality of heat-exchanging tubes and a plurality of heat-exchanging fins extending from the heat exchanging tubes, made from the aluminum-containing metal composite material as claimed in claim 1.

* * * * *